United States Patent [19]

Springer

[11] Patent Number: 5,010,955

[45] Date of Patent: Apr. 30, 1991

[54] CASING MILL AND METHOD

[75] Inventor: Johann B. Springer, Hanover, Fed. Rep. of Germany

[73] Assignee: Smith International, Inc., Houston, Tex.

[21] Appl. No.: 530,107

[22] Filed: May 29, 1990

[51] Int. Cl.[5] ..... E21B 10/46; E21B 29/00

[52] U.S. Cl. ..... 166/298; 166/55.6; 166/55.8; 166/376; 166/240; 175/269; 175/279; 175/289

[58] Field of Search ..... 166/55, 55.1, 55.8, 166/55.7, 55.6, 298, 240; 175/269, 267, 279, 286, 289, 280; 30/103, 104, 108

[56] References Cited

U.S. PATENT DOCUMENTS

| | | | |
|---|---|---|---|
| 2,353,284 | 7/1944 | Barrett | 166/55.8 |
| 2,899,000 | 8/1959 | Medders et al. | 166/55.8 |
| 2,940,522 | 6/1960 | Taylor et al. | 166/55.8 X |
| 3,114,416 | 12/1963 | Kammerer | 166/55.7 |
| 3,289,760 | 12/1966 | Kammerer | 166/55.8 X |
| 3,351,134 | 11/1967 | Kammerer | 166/55.8 |
| 3,684,009 | 8/1972 | Murray | 166/55.8 |

*Primary Examiner*—Stephen J. Novosad
*Attorney, Agent, or Firm*—Christie, Parker & Hale

[57] ABSTRACT

A casing mill for milling pipe cemented in an oil well comprises a body with a plurality of fixed milling blades having a diameter corresponding to the outside diameter of the pipe to be milled, and a second plurality of movable blades movable between a retracted position smaller than the inside diameter of the pipe to be milled, and an extended diameter corresponding to the outside diameter of a pipe coupling between adjacent sections of pipe. Means are provided for selectively moving the blades between the retracted and extended positions in response to drilling fluid flow. A stabilizer keeps the casing mill centered in the pipe to be milled. In this way, one can mill both the pipe and coupling in the vicinity of a coupling and mill only pipe between the vicinities of adjacent couplings.

26 Claims, 5 Drawing Sheets

13
23
22
21
47
43
46
44
31
47
22
28
29
31
28
22
31
32
26
27
24
22
21
42
34
41
33

13
56
67
11
58
58
59
57
57
66
12
68
61
62
61
63
12
64

CASING MILL AND METHOD

FIELD OF THE INVENTION

Oil wells and the like are commonly provided with a steel pipe casing lining the well bore. It is also common in some types of well completions to provide an inner steel casing within the outer steel casing through at least a portion of the well depth. The inner casing may hang free within the outer casing or may be cemented in place by a cement grout injected between the two casings.

It also occurs from time to time that it is desired to remove the inner casing for rework of the well, redrilling, drilling of a second well through the same surface casing or the like. Where the casing is hanging free in the well bore, a pipe joint may be backed off or a casing cutter may be used for cutting through the inner casing near the lower end of the uncemented section, and the freed casing may then be lifted from the well bore. Those portions of the inner casing which are cemented in place are then "milled" by a downhole tool, such as a pilot mill, which essentially machines the steel pipe to chips or cuttings which are pumped from the well in a mud slurry or the like. Various types of casing mills have, therefore, been developed for machining the pipe in oil wells.

There are several reasons that it is usually desirable to mill just the steel of the casing and little, if any, of the surrounding cement. An important reason is that any milling activity beyond the steel pipe of the inner casing may cut into the steel pipe of the outer casing, thereby reducing its thickness and leaving permanent damage in the well bore. This may occur since the inner casing is not necessarily centered within the outer casing. Well bores commonly deviate from vertical and the inner casing may lie against the lower side of a non-vertical hole. Further, even when the hole is nearly vertical, small bends in the path of the bore may result in the inner casing being pulled against the side of the outer casing due to the weight of the casing hanging in the well bore before it is cemented.

The casing in a well bore is in the form of steel pipe with male threads at each end, with adjacent pieces of pipe being interconnected by pipe couplings external to the pipe. Thus, the casing string may have a diameter two or three centimeters greater at the location of a coupling than it does through the length of a piece of pipe. Thus, to assure that all of the casing string is milled from the well, it has been the practice to employ a casing mill with a cutting diameter corresponding to the outside diameter of the couplings. This means that through the length of pipe between couplings, some of the cement surrounding the inner casing is milled by the casing mill.

In a straight hole or near the surface, this is typically little problem since the couplings tend to space the inner casing away from the wall of the outer casing by at least the thickness of the coupling. Thus, although the couplings on the inner casing may bear against the inside of the outer casing, the center portion of the pipe between casings is spaced apart from the outer casing a sufficient distance that damage to the outer casing is largely avoided.

The same is not necessarily true in a crooked hole since it has been observed that the weight of the casing string may pull the center portion of the pipe between couplings closer to the convex side of the hole than the thickness of the coupling. It has also been learned that this effect is a function of a number of variables including the curvature of the hole, the properties of the casing and the weight of casing hanging below the portion of the hole of interest. In those places where the center portion of the inner pipe is pulled toward or against the side of the outer pipe, milling with a casing mill having the outside diameter of the couplings may lead to significant damage to the outer casing. Further, the rate of milling and the length of casing milled before the mill needs replacement are considerably reduced.

Casing mills are typically kept centered in the casing being milled by a stabilizer or multiple stabilizers above and/or below the casing mill, thereby assuring that all of the steel of the casing string is milled away. The problem of milling into the outer casing in sections between couplings may be alleviated by using undersize stabilizers which permit the casing mill to "wander" within the inner casing. When the outer casing is encountered by the mill, it tends to push the mill away from the outer casing and minimize damage to the outer casing. A problem with this is that there may be insufficient stabilization to properly mill the couplings between sections of pipe. The rate of milling is also reduced, thereby increasing cost.

SUMMARY OF THE INVENTION

There is, therefore, provided in the practice of this invention according to a presently preferred embodiment a technique for milling a well casing by milling a section of pipe with fixed blades on a tool body to an elevation above a coupling, and then extending movable blades on the tool body for milling through the coupling. Once the coupling has been milled, the movable blades are retracted so that the next piece of pipe is milled by the fixed blades.

A casing mill for practice of this technique has a tubular body with a diameter smaller than the inside diameter of the casing to be milled. A first group of milling blades fixed on the body extend to a diameter corresponding to the outside diameter of the pipe to be milled. A second group of milling blades are mounted on the body for motion between a retracted position having a diameter smaller than the inside diameter of the pipe, and an extended position at a diameter corresponding to the outside diameter of a coupling between sections of pipe. Both sets of blades have material for cutting the end of the metal casing. A "switch", preferably activated by drilling fluid pressure, is used for selectively moving the movable blades between the retracted and extended positions. The mill is stabilized so that it remains centered within the casing being milled.

BRIEF DESCRIPTION OF THE DRAWINGS

These and other features and advantages of the present invention will be appreciated as the same becomes better understood by reference to the following detailed description when considered in connection with the accompanying drawings, wherein.

DETAILED DESCRIPTION

Figure 2:
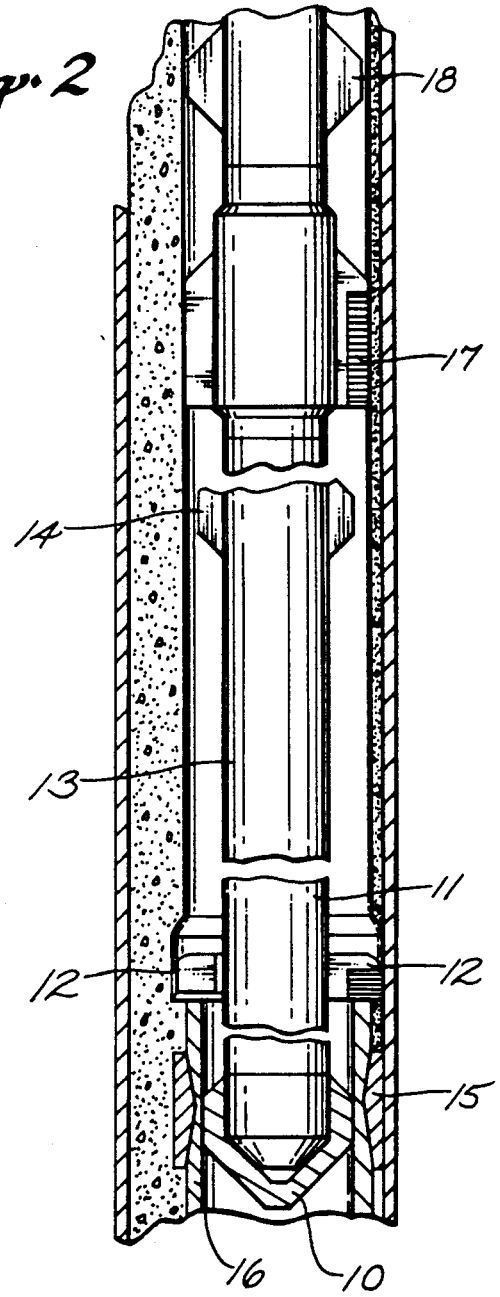
FIG. 2 illustrates the mill in its position for milling the coupling between pipe sections.
Figure 1:
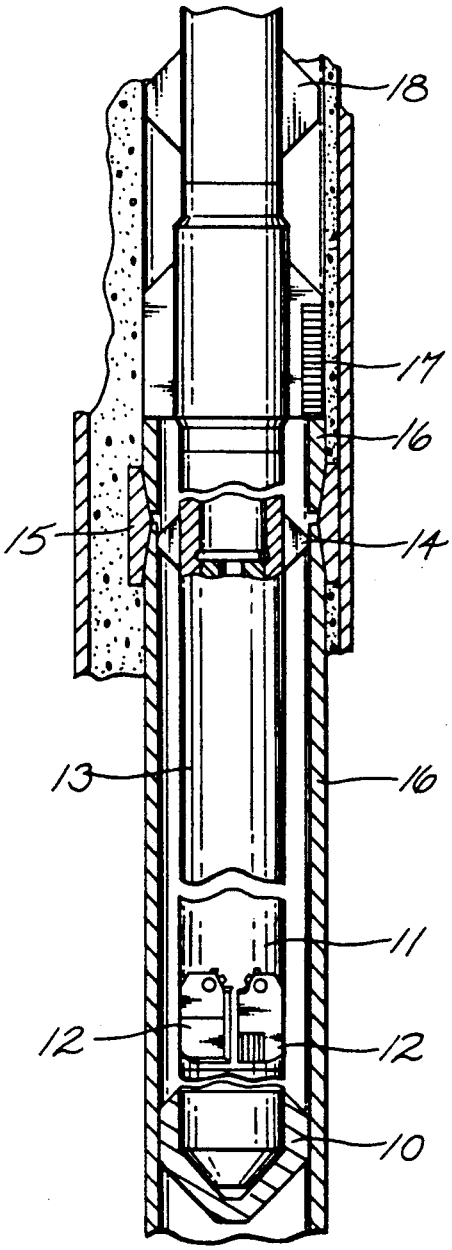
FIG. 1 illustrates an exemplary casing mill as it mills metal pipe between couplings in an oil well.

FIGS. 1 and 2 provide external side views of an exemplary casing mill, as provided in practice of this invention, in two positions as it mills pipe 16 and coupling 15, respectively, in a well bore. For purposes of this illustration, portions of the length of the casing mill have been deleted for convenience of illustration. It will be recognized that the total length of the casing mill may be substantially more than suggested by the portions illustrated. For example, for milling standard 13⅜ inch (34 cm) casing, the total length of the assembly is in the order of six meters. It will also be apparent that, as is commonplace in downhole tools, the casing mill is made from several sections threaded together.

At the lower end of the casing mill, there is a conventional stinger 10 having a conical end for entering the end of the casing to be milled. The stinger may be essentially smooth or may include tungsten carbide or similar cutting material for milling occasional junk within the casing. The outside surface of the stinger typically has a diameter only slightly smaller than the inside diameter of the casing for providing stabilization at the lower end of the casing mill. Excessive stabilization is avoided by providing a small degree of flexibility in the tubular body connecting the head of the stinger with the lower cutting portion of the casing mill.

Next above the stinger is a coupling milling section 11 on which are mounted a plurality (typically, three) of movable cutting blades 12. As described in greater detail hereinafter, the movable blades are movable between a retracted position, as illustrated in FIG. 1, and an extended position, as illustrated in FIG. 2.

Figure 3:
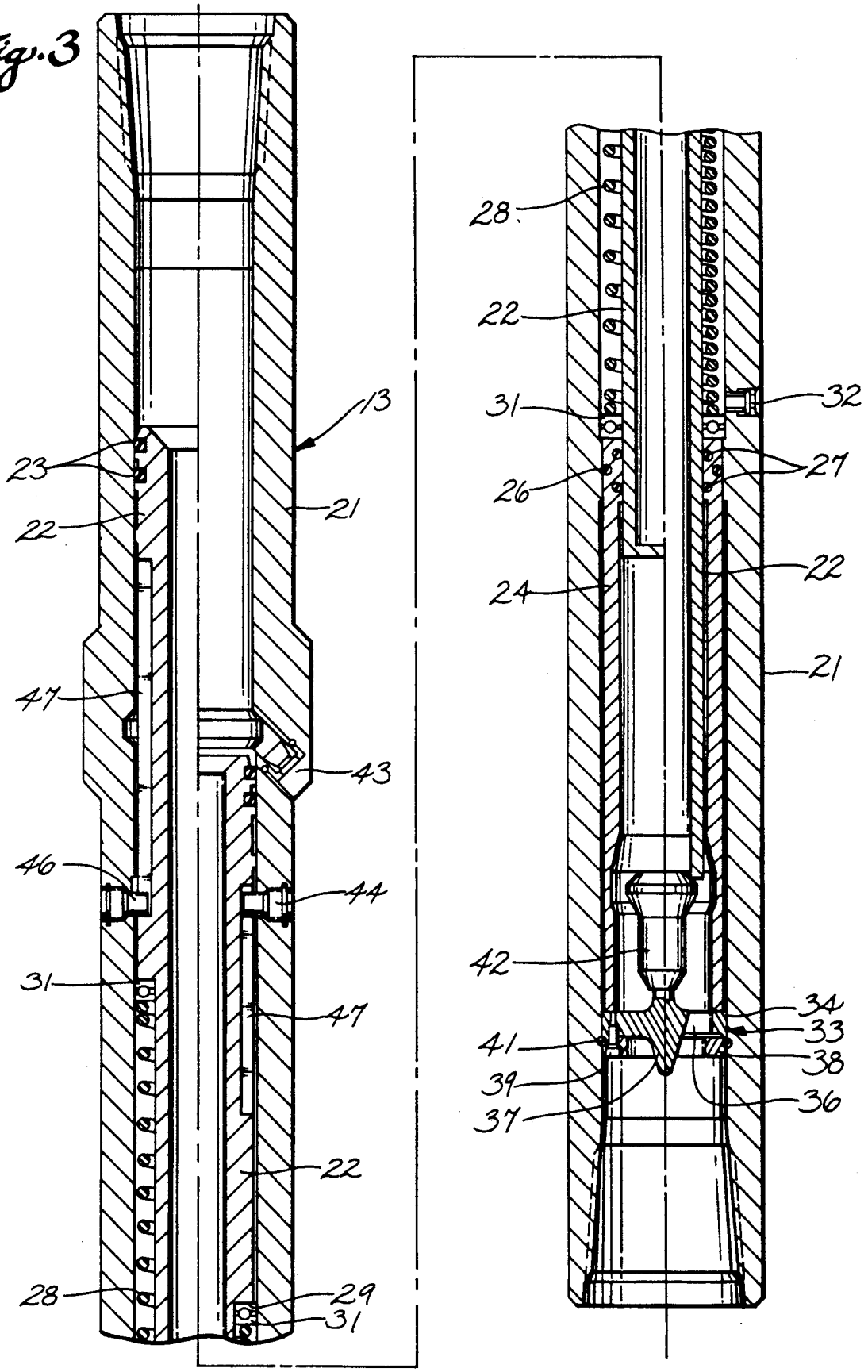
FIG. 3 is a longitudinal cross section through switching means for selecting extension or retraction of movable blades on the casing mill, the left half of the section illustrating the switching means in the switching position, and the right half illustrating the switching means in the position where the milling blades are retracted.
Figure 4:
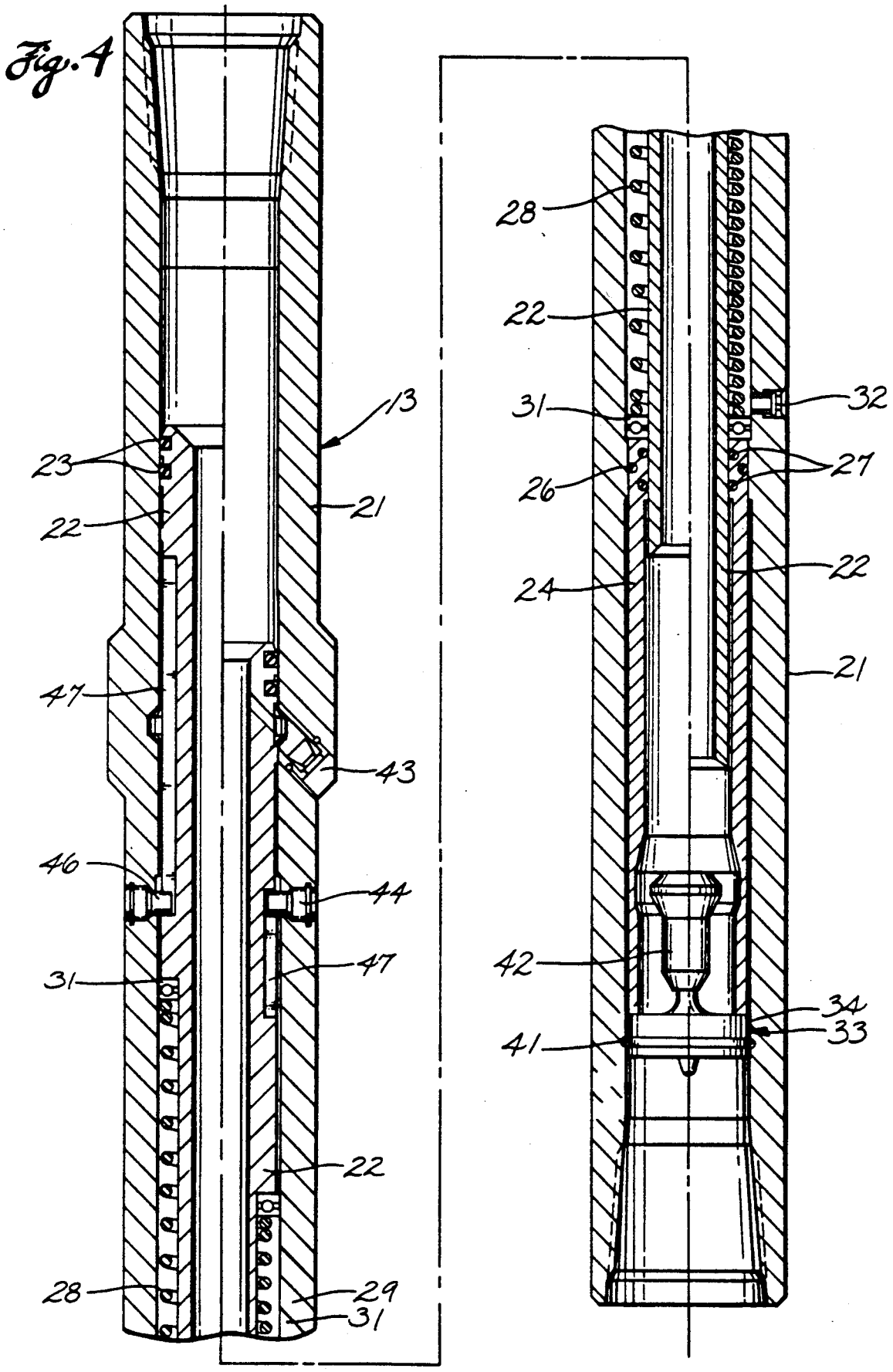
FIG. 4 is a longitudinal cross section of the switching means, with the left half of the drawing illustrating the switching means in the switching position, and the right half illustrating the switching means in its position where the movable blades are in their extended position.

Above the coupling mill section is a mechanism 13 for switching the movable blades between the extended and retracted positions. In the preferred embodiment as illustrated in FIGS. 3 and 4, the switching mechanism is operated by the hydraulic pressure of drilling fluid or "mud."

Above the switching mechanism is a central blade-type stabilizer 14 having an outside diameter corresponding to the inside diameter of the pipe 16 to be milled for keeping the casing mill centered within the pipe.

Above the central stabilizer 14 is a pipe milling section having a plurality (typically from three to eight) of pipe cutting blades 17 extending radially from the body of the casing mill. Each of the fixed blades comprises a steel fin with a plurality of cemented tungsten carbide inserts brazed on the face of the fin to engage the steel of the end of the casing with a negative rake of several degrees suitable for rapid and efficient milling of the steel. The arrangement of tungsten carbide inserts on the fin is now conventional for a casing mill.

The outside diameter of the group of fixed blades corresponds to the outside diameter of the pipe being milled. The diameter of the blades does not need to be exactly the same as the diameter of the pipe, but may be a millimeter or two larger or smaller, and still successfully mill all of the steel of the pipe.

Another feature of the fixed blades might also be noted. As the cemented tungsten carbide inserts wear away during milling of the pipe, the remaining portion of the fins enters the bore of the pipe and augments the stabilization provided by the central stabilizer, thereby firmly aligning the fixed blades in a central location in the pipe being milled.

Above the section having the fixed blades, there is a conventional spiral stabilizer 18 which is optional but desirable. The outside diameter of the upper stabilizer corresponds roughly to the diameter of the hole after the pipe is milled. Above the upper stabilizer, conventional drill collars (not illustrated) or the like are connected at the lower end of the drill string for providing sufficient weight for the milling operation.

At the beginning of the job for removing the inner casing from a well, the portion of the casing that is not embedded in cement is cut or backed off and retrieved from the well. If desired, some of the casing embedded in cement may be milled with conventional pilot mills or casing mills where there is little or no hazard of damage to the outer casing. For example, a conventional fixed size pilot mill may be quite acceptable for milling the inner casing where centralizers had been used at the time of original installation of the inner casing. The dual outside diameter casing mill provided in practice of this invention may be reserved for those portions of the hole depth where problems in use of conventional pilot mills might be expected or are unexpectedly encountered.

When the dual outside diameter casing mill is run into the well, the coupling milling blades 12 are retained in their retracted position. The stinger 10 enters the inner casing, and the mill is lowered until the fixed pipe cutting blades 17 encounter the end of the pipe. In the embodiment described in greater detail hereinafter, the movable blades are extended by application of hydraulic pressure of drilling mud when the switching mechanism is in the appropriate position. Generally, the initial setting of the switching mechanism may not be known to the rig operator. Thus, when the mud pumps are turned on, the blades may or may not become extended. This can be tested before milling commences.

After the fixed blades have touched down on the end of the pipe, the drill string is raised a distance in excess of the spacing between the movable blades and fixed blades. Mud circulation is then commenced and the drill string is lowered slowly without rotation to see if the movable blades touch the end of the casing. If the depth where the end of the casing is encountered (as shown by the weight indicator on the drill rig) is the same as before, it is known that the movable blades are retracted and milling of the pipe may commence. On the other hand, if the end of the pipe is encountered at an elevation higher than before corresponding to the distance between the blades, it is known that the movable blades are in their extended position. In that event, mud circulation is stopped for retracting the blades, and mud circulation recommenced. The switching mechanism leaves the blades in their retracted position, and milling of the pipe may then commence.

Milling of pipe with the fixed blades 17 is continued to a short distance above the elevation of a pipe coupling 15. The mud pumps are then shut down. The drill string is raised a short distance more than the spacing between the fixed and movable blades, and the mud pumps are turned back on. This causes the movable blades to be biased toward their extended position, and milling is resumed. In a short distance the movable blades move to their extended position and have a sufficient outside diameter for milling the coupling between pipes. After a sufficient distance has been milled to assure that the coupling is completely milled, mud circulation is again interrupted and the tool lifted enough to permit the movable blades to retract. Mud circulation is resumed and the mill is lowered a distance corresponding to the spacing between the blades to resume milling the next piece of pipe with the fixed blades. This cycle is repeated for milling each coupling through the troublesome section of the casing.

In the exemplary embodiment, the distance between the fixed blades and movable blades and the differential fluid pressure drops, depending on whether the movable blades are retracted or extended, provide positive indicators of the mode of operation of the dual diameter casing mill.

Figure 5:
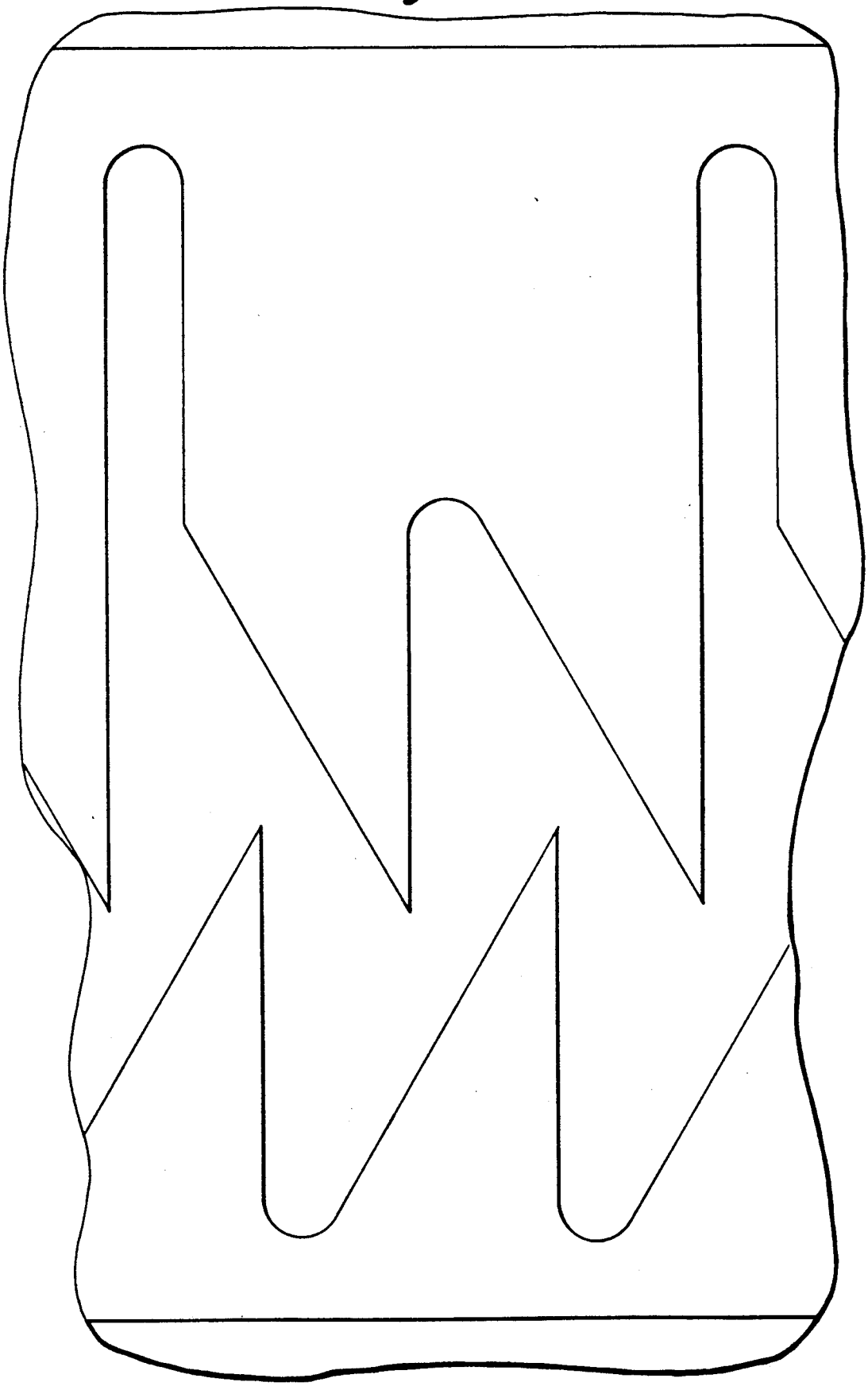
FIG. 5 is a schematic "unwrapped" illustration of a slot in the switching means piston for latching alternately in the extended or retracted positions.

FIGS. 3 to 5 illustrate an exemplary switching mechanism for selecting the modes of operation of the movable blades in their retracted or extended position. The left-hand side of each of FIGS. 3 and 4 illustrates the interior of the switching mechanism when it is in its switching position between the blade-extended and blade-retracted positions. The right-hand side of FIG. 3 illustrates the position of the parts of the switching mechanism when in the blade-retracted position. The right-hand side of FIG. 4 illustrates the mechanism in the blade-extended position.

The entire switching mechanism is in a tubular housing 21 which is threaded at each end for connection between other portions of the casing mill. A movable piston 22 can slide longitudinally in the housing and is sealed to the housing at its upper end by o-rings 23. Surrounding the lower end of the piston is a spring support sleeve 24 which is sealed to the housing by an o-ring 26. The inside of the spring support sleeve is sealed to the outside of the piston by o-rings 27.

A compression spring 28 fits in an annular chamber between the end of the spring support sleeve and a downwardly facing shoulder 29 on the piston. Bearings 31 are provided at each end of the spring for facilitating rotation of the piston. A screened opening 32 provides venting for the annular spring chamber and prevents rock fragments from entering the chamber.

The lower end of the spring support sleeve 24 is supported in the housing on a stinger body 33. The stinger body has a rim 34 in the housing and three spokes 36 supporting a central hub 37. Drilling fluid may flow through the openings between the spokes. The stinger body is connected to an annular cap 38 by cap screws 39. The exterior surface of the cap is tapered for forcing a bail 41 into an annular groove in the housing and locking the stinger assembly in place.

A stinger plug 42 is assembled on the hub of the stinger body. When the piston 22 is in its lowermost position with the movable arms retracted, the lower end of the piston engages the upper end of the plug, forming a closure which prevents substantial mud flow circulation through the full length of the switching mechanism (right-hand side of FIG. 3). At the same time, the upper end of the piston clears three bypass nozzles 43 extending through the wall of the housing. The bypass nozzles eject drilling mud into the annulus outside of the casing mill for cooling and removing chips from the fixed milling blades which are above the switching mechanism.

The position of the piston is limited by a pair of piston guide screws 44 threaded through the wall of the housing. Each of the guide screws has a cylindrical end 46 which fits into a zigzag ball-pen slot 47 in the outside wall of the piston. This is referred to as a ball-pen slot by analogy to a mechanism used for alternately extending or retracting the tip of some ballpoint pens.

The ball-pen slot is further illustrated in the fragmentary view of FIG. 5. The ball-pen slot extends completely around the piston and FIG. 5 illustrates schematically a little more than 180° around the circumference as if the cylindrical surface were unwrapped and laid flat. Thus, FIG. 5 is a face view of one-half of the ball-pen slot. The other half of the slot, which is not illustrated, is a repetition of the illustrated portion.

The ball-pen slot has switching pockets 48 90° apart at the lowest extent of the slot. A pair of elongated retracted position pockets 49 are spaced 180° apart around an upper part of the piston and 45° offset from the switching pockets. A pair of extended position pockets 51 are 180° apart and 90° between the retracted position pockets 49. The extended position pockets extend a shorter distance up the piston than the retracted position pockets.

When the must pumps are turned off and there is no mud circulation to the casing mill, the spring 28 drives the piston 22 to its uppermost position (left side of FIGS. 3 and 4) and the piston guide screws 44 are in the switching pockets 48 of the ball-pen slot.

When the mud pumps are turned on, the pressure on the top of the step piston increases while the pressure under the head of the postion is exposed to the lower pressure of the annulus beyond the fluid exit nozzles (via the spring chamber). The differential fluid pressure across the step piston drives the piston downwardly. As the piston moves downwardly, the cylindrical ends of the drive screws each engage a diagonal upper camming surface 52 in the ball-pen slot. This causes the piston to rotate, and depending on which two of the four switching pockets the guide screws happen to have been in, the guide screws enter either the retracted-position pockets 49 or extended-position pockets 51, thereby limiting the stroke of the piston, depending on the depth of the respective pockets. The piston can move downwardly further when in its retracted position and the guide screws are in the retracted position pockets 49.

It will be noted that when the mud circulation is again discontinued, the spring restores the piston toward its upper switching position and the ends of the guide screws encounter lower camming surfaces 53, which rotate the piston an additional 45°. Thus, during each cycle of turning the pumps off and on, the piston is rotated 90° and is alternately cycled between its extended and retracted positions.

When the piston is in its relatively higher extended position, the upper end of the piston closes access to the bypass nozzles 43 (right side of FIG. 4), and drilling fluid flows through the length of the piston and past the stinger body. On the other hand, when the piston is in its lower retracted position, the end of the piston closes against the stinger plug 42 and the bypass nozzles are exposed, thereby diverting mud flow through the nozzles instead of through the lower end of the switching mechanism.

The flow cross-sections through the nozzle 68 in the coupling mill and through the nozzles 43 adjacent to the casing mill blades are different, so that different pressure drops may be sensed for indicating whether the casing mill is in its retracted or extended mode of operation.

Figure 6:
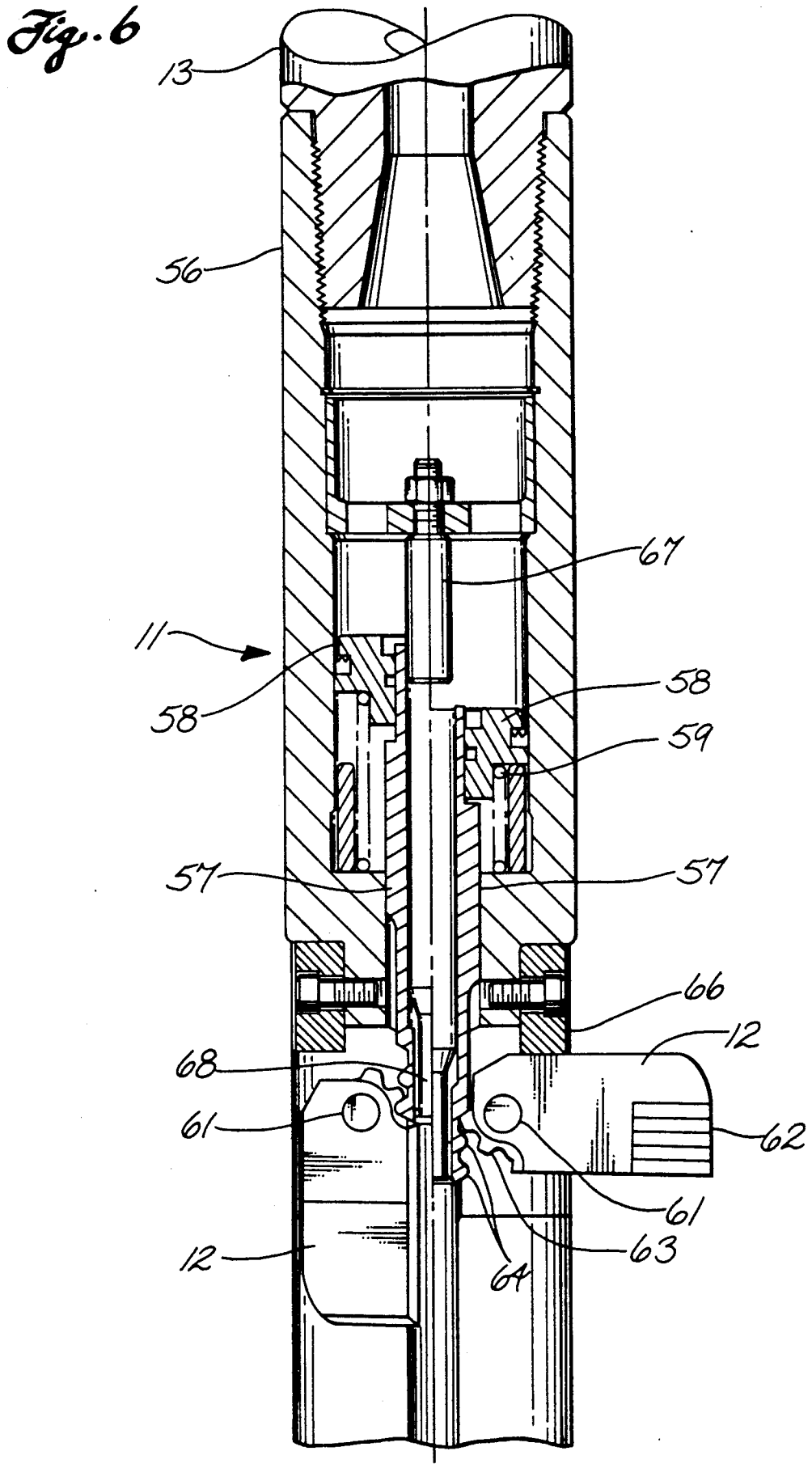
FIG. 6 is a longitudinal cross section through the movable blade portion of an exemplary casing mill, with the left-hand side of the drawing illustrating a blade retracted, and the right-hand side of the drawing illustrating a blade extended.

FIG. 6 illustrates a longitudinal cross-section through an exemplary mechanism for extending the movable arms or cutting blades 12 of the casing mill for milling a pipe coupling. Such a mechanism is conventional and exemplary of arm-extension mechanisms which may be used in practice of this invention. The body 56 of the coupling mill section of the casing mill is threaded at the ends for assembly between the stinger 10 and switching mechanism 13. A piston stem 57 secured to a piston head 58 is mounted in the body for translation along its length. The piston is biased upwardly by a piston spring 59. The piston is moved downwardly by drilling fluid pressure on the piston head.

Three cutting blades 12 are in the form of arms mounted on pivot pins 61 secured in the body. The outer end of each arm has a plurality of cemented tungsten carbide cutting elements 62 brazed on the face of the arm at an angle for providing an appropriate negative rake for cutting the steel of the pipe and coupling. At the inner end of each arm there are a few gear teeth 63 which engage complementary teeth 64 in the form of ridges around the piston stem 57. Thus, as the piston stem moves upwardly, the cutting blades are pivoted toward their retracted position (left side of FIG. 6), and when the piston moves downwardly, the cutting blades are pivoted toward their extended position (right side of FIG. 6).

When the arms are extended, the cutting forces tend to keep arms fully open against arm stops 66. The tool should, therefore, be lifted off of the cutting face when the mud pumps are turned off and it is desired to retract the arms. If the arms should get stuck toward their extended positions, they are easily pressed toward the retracted position by lifting the tool so that the arms engage a portion of the hole where only the fixed blades have been used.

When the blades are extended and the piston stem is in its lower position, drilling fluid flows through the hollow piston and out the lower end for cooling the cutting blades and removing chips. When the piston is toward its upper position, the opening through the piston is reduced by a stinger 67. The resultant higher pressure required to pump the drilling fluid through the piston indicates positively whether the arms are extended.

Although the described arrangement for milling casing is preferred, it will be apparent that many modifications and variations may be provided. Thus, for example, one may employ a single set of cutting blades movable between a retracted position where only the pipe is cut and an extended position where both pipe and coupling are cut. Similarly, two sets of adjustable blades may be used. The described arrangement with fixed blades for milling pipe and adjustable blades for milling pipe plus coupling is desirable since the wear accommodation for the two sets of blades can be readily adjusted so that blades cutting 30 feet or more of pipe per coupling tend to wear out in about the same interval as the movable blades which cut only a short length adjacent to the coupling.

It will also be noted that the adjustable and fixed blades may be arranged at the same elevation on the casing mill or at different elevations. Having the movable blades beneath the fixed blades as in the present embodiment provides a ready ability to distinguish whether the blades are extended or retracted. This arrangement is also preferred for stabilization of the casing mill. Having the two cutting structures at different elevations also permits the use of larger cutting surfaces and enhances life time of the casing mill.

Although the simple expedient of turning the mud circulation on and off is desirable for switching operation of the casing mill between the fixed and movable blades, other arrangements may also be used. These include changes in mud flow rate, mechanical devices that change the path of mud flow, and pulses sent through the mud system for activating a downhole servo motor. One may also activate blade extension by means of a wire line from the surface.

The zigzag ball-pen slot in the illustrated embodiment is provided around the perimeter of the piston with guides extending inwardly through the housing wall to fit into the slot. Alternatively, a slot may be provided within the housing and be engaged by guide means extending outwardly from the piston. Other means may be employed for switching the piston between the extended and retracted positions.

Many other modifications and variations will be apparent to those skilled in the art, and it is, therefore, to be understood that, within the scope of the appended claims, the invention may be practiced otherwise than as specifically described.

What is claimed is:

1. A casing mill for milling the end of a metal casing pipe in a well comprising:

a tubular body having a diameter smaller than the inside diameter of a pipe be milled;

a first plurality of milling blades fixed on the body extending to a diameter corresponding to the outside diameter of the pipe to be milled, the blades including a cutting material for cutting the end of the metal pipe;

a second plurality of milling blades mounted on the body for motion between a retracted position having a diameter smaller than the inside diameter of the pipe to be milled and an extended position at a diameter corresponding to the outside diameter of a pipe coupling to be milled, the blades including a cutting material for cutting the end of the metal pipe and a surrounding coupling;

switch means for selectively moving the second plurality of blades between the retracted and extended positions; and stabilizer means for maintaining the mill centered in the pipe being milled.

2. A casing mill as recited in claim 1 wherein the movable blades are below the fixed blades.

3. A casing mill as recited in claim 2 further comprising means for directing drilling fluid flow to the lower blades when extended and diverting drilling fluid flow to the upper blades when the lower blades are retracted.

4. A casing mill as recited in claim 1 comprising a stabilizer between the fixed and movable blades.

5. A casing mill as recited in claim 1 wherein the switch means is activated by drilling fluid pressure changes.

6. A casing mill as recited in claim 5 wherein the switching means comprises:

a piston in the body movable between an upper position and a lower position;

means cooperating with the piston for directing drilling fluid flow to the movable blades when the piston is in its position; and means cooperating with the piston for directing drilling fluid flow away from the movable blades when the piston is in its lower position.

7. A casing mill as recited in claim 6 wherein the switching means further comprises means for passing the piston through a switching position between upper and lower positions which is lower than the lower position.

8. A casing mill as recited in claim 6 comprising:

a zigzag ball-pen slot around the piston and means engaging the slot for guiding the piston between its upper position, its lower position, and an intermediate switching position; and means for rotating the piston for alternately moving the piston between its upper and lower positions.

9. A casing mill as recited in claim 1 wherein the switching means comprises:

a hollow piston in the housing;

a zigzag ball-pen slot around the piston, including alternating extended-position pockets and retracted-position pockets at one end of the zigzag and intermediate switching pockets at the other end of the zigzag;

spring means for biasing the piston toward the intermediate switching position;

means for restricting fluid flow to the second plurality of milling blades when the piston is in its retracted position; and means for permitting fluid flow to the second plurality of milling blades when the piston is in its extended position.

10. A casing mill as recited in claim 9 wherein the means for restricting fluid flow to the second plurality of blades comprises a plug for plugging the lower end of the hollow piston when the piston is in its retracted position.

11. A casing mill as recited in claim 10 further comprising means for diverting fluid flow to the first plurality of blades when the piston is in its retracted position.

12. A casing mill as recited in claim 11 wherein the piston in its extended position blocks the means for directing fluid flow toward the first plurality of cutting blades, and wherein the lower end of the piston is remote from the plug.

13. A casing mill for milling oil well casing having sections of pipe coupled together by external couplings comprising:

a housing;

blades on the housing having a diameter sufficient for milling only pipe;

movable blades on the housing movable to a diameter sufficient for milling both pipe and coupling;

means in the housing for moving the movable blades to the diameter sufficient for milling both pipe and coupling; and means for stabilizing the housing centered in a pipe to be milled.

14. A casing mill as recited in claim 13 wherein the blades for milling only pipe are fixed.

15. A casing mill as recited in claim 14 comprising a stabilizer between the fixed and movable blades.

16. A casing mill as recited in claim 13 wherein the movable blades are below the blades for milling only pipe.

17. A casing mill as recited in claim 16 further comprising means for directing drilling fluid flow to the lower blades when extended and diverting drilling fluid flow to the upper blades when the lower blades are retracted.

18. A casing mill as recited in claim 13 wherein the switch means is activated by drilling fluid pressure changes.

19. A casing mill as recited in claim 13 wherein the switching means comprises:

a piston in the body movable between an upper position and a lower position;

means cooperating with the piston for directing drilling fluid flow to the movable blades when the piston is in its upper position; and means cooperating with the piston for directing drilling fluid flow away from the movable blades when the piston is in its lower position.

20. A casing mill as recited in claim 19 wherein the switching means further comprises means for passing the piston through a switching position between upper and lower positions which is lower than the lower position.

21. A casing mill as recited in claim 20 comprising:

a zigzag ball-pen slot around the piston and means engaging the slot for guiding the piston between its upper position, its lower position, and an intermediate switching position; and means for rotating the piston for alternately moving the piston between its upper and lower positions.

22. A casing mill as recited in claim 13 wherein the switching means comprises:

a hollow piston in the housing;

a zigzag ball-pen slot around the piston, including alternating extended-position pockets and retracted-position pockets at one end of the zigzag and intermediate switching pockets at the other end of the zigzag;

spring means for biasing the piston toward the intermediate position;

means for restricting fluid flow to the movable blades when the piston is in its retracted position; and means for permitting fluid flow to the movable blades when the piston is in its extended position.

23. A method for milling a well casing having a plurality of pipe sections interconnected by external couplings comprising the steps of:

milling a section of pipe with fixed blades on a tool body to an elevation above a coupling;

extending movable blades on the tool body; milling the coupling;

retracting the movable blades; and milling the next section of pipe below the coupling with the fixed blades.

24. A method as recited in claim 23 wherein the movable blades are below the fixed blades, and comprising the step of raising the tool with the movable blades retracted a distance of at least the distance between the fixed blades and the movable blades before extending the movable blades.

25. A method as recited in claim 23 wherein the movable blades are below the fixed blades and comprising the step of raising the tool with the movable blades retracted until the movable blades are above the milled end of the casing and thereafter extending the movable blades.

26. A method for milling casing cemented in an oil well, the casing comprising a plurality of pipe sections interconnected by a plurality of couplings external to the pipe sections comprising:

milling both pipe and couplings in the vicinity of couplings; and milling only pipe between the vicinities of adjacent couplings.

* * * * *